US010119179B2

(12) United States Patent
Matsumoto et al.

(10) Patent No.: US 10,119,179 B2
(45) Date of Patent: Nov. 6, 2018

(54) TITANIUM PLATE

(71) Applicant: KOBE STEEL, LTD., Kobe-shi (JP)

(72) Inventors: Katsushi Matsumoto, Kobe (JP); Yoshinori Ito, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 212 days.

(21) Appl. No.: 14/916,501

(22) PCT Filed: Sep. 19, 2014

(86) PCT No.: PCT/JP2014/074923
§ 371 (c)(1),
(2) Date: Mar. 3, 2016

(87) PCT Pub. No.: WO2015/046084
PCT Pub. Date: Apr. 2, 2015

(65) Prior Publication Data

US 2016/0208365 A1 Jul. 21, 2016

(30) Foreign Application Priority Data

Sep. 24, 2013 (JP) ..... 2013-197238

(51) Int. Cl.
*C22C 14/00* (2006.01)
*C22F 1/18* (2006.01)

(52) U.S. Cl.
CPC ..... *C22C 14/00* (2013.01); *C22F 1/183* (2013.01)

(58) Field of Classification Search
CPC ..... C22C 14/00
See application file for complete search history.

(56) References Cited

U.S. PATENT DOCUMENTS

2012/0193084 A1 8/2012 Fujita et al.

FOREIGN PATENT DOCUMENTS

| | | | |
|---|---|---|---|
| JP | 4088183 | B2 | 10/2004 |
| JP | 2008-127633 | A | 6/2008 |
| JP | 2009-215601 | A | 9/2009 |
| JP | 2010-31314 | A | 2/2010 |
| JP | 2010-150607 | | 7/2010 |
| JP | 2011-26626 | A | 2/2011 |
| JP | 2012-158776 | A | 8/2012 |
| JP | 2013-181246 | A | 9/2013 |

OTHER PUBLICATIONS

International Search Report and Written Opinion dated Dec. 9, 2014, in PCT/JP2014/074923 filed Sep. 19, 2014.

*Primary Examiner* — Christopher S Kessler
(74) *Attorney, Agent, or Firm* — Oblon, McClelland, Maier & Neustadt, L.L.P.

(57) ABSTRACT

A titanium plate according to the present invention contains a predetermined amount of Fe and O with the remainder consisting of titanium and inevitable impurities, and has a grain microstructure of the α-phase having a HCP structure. In the titanium plate, the total area in which α-phase grains specified by a first angle (θ) are included is a predetermined value of a ratio (P) or (R) and the total area in which α-phase grains specified by a second angle (φ) are included is a predetermined value of an area ratio (Q) or (S) in a (0001) pole figure of α-phase grains, and the average value and the maximum value of an equivalent circle diameter in the α-phase grains are respectively predetermined values.

16 Claims, 6 Drawing Sheets

TITANIUM PLATE

TECHNICAL FIELD

The present invention relates to a titanium plate, and relates more specifically to a titanium plate used for a plate type heat exchanger for example.

BACKGROUND ART

Because a titanium plate is excellent in corrosion resistance, it is used widely for members for a heat exchanger of a chemical plant, a power plant, a food processing plant, and the like, consumer products such as a camera body and a kitchen instrument, members for transportation equipment such as a motorcycle and an automobile, and exterior material for household electrical appliances and the like.

Among them, with respect to the plate type heat exchanger, in order to improve the heat exchange efficiency, it is necessary to work the titanium plate into a corrugated shape by press-forming, and to increase the surface area. Therefore, when a titanium plate is to be applied to a plate type heat exchanger, excellent formability is required for the titanium plate.

Also, when a titanium plate is to be applied to a plate type heat exchanger, in addition to the formability described above, strength of a specific level or more is also required for the titanium plate in order to achieve improvement of the durability and weight reduction required as the plate type heat exchanger.

Here, the titanium plate (pure titanium for industrial use) is specified in the standards of JIS H 4600, and is classified to the grades of JIS Type 1, Type 2, Type 3, and the like according to the content of Fe, O, and the like, the strength, and so on. As the grade becomes higher, the content of Fe, O, and the like increases and the strength becomes higher, and therefore, when a titanium plate is to be used for the use requiring a high strength, those with a high grade are used. In contrast, a titanium plate with a low grade namely the titanium plate of JIS Type 1 for example has less content of Fe, O, and the like, and the ductility becomes high (the formability improves). Therefore, when a titanium plate is to be used for a use requiring excellent formability, those of JIS Type 1 are used.

However, when the content of Fe, O, and the like is increased and the strength of the titanium plate is improved, the formability deteriorates, whereas when the content of Fe, O, and the like is reduced and the formability of the titanium plate is improved, the strength deteriorates.

Also, as a method for improving the strength of a titanium plate, there also exists a method of refining the grains of the titanium plate, however, the formability of the titanium plate deteriorates accompanying refinement of the grains.

As described above, when a titanium plate is to be applied to a plate type heat exchanger, there is a fact that the strength of a specific level or more (the strength of JIS Type 2, Type 3) and excellent formability are required for the titanium plate. However, it was very difficult to improve the formability while avoiding deterioration of the strength.

Therefore, in the past, with respect to a titanium plate, various technologies as described below focusing on improvement of the strength and the formability have been disclosed.

For example, in Patent Literature 1, there is disclosed a method for manufacturing a titanium plate excellent in formability which has the crystal structure of a hexagonal system and contains a predetermined amount of H, O, N, and Fe with the remainder consisting of Ti and inevitable impurities, and in which the Kearns factor f value defined by a predetermined formula is 0.60 or more.

In Patent Literature 2, a titanium plate excellent in bendability and stretch formability is disclosed which contains a predetermined amount of Fe and O with the remainder consisting of Ti and inevitable impurities and has an equiaxed $\alpha+\beta 2$ phase microstructure, and in which the angle between the direction showing the peak of the (0001) pole figure of the $\alpha$ phase and the normal direction of the rolling direction is 40° or more.

In Patent Literature 3, a titanium plate having a high strength and excellent in formability is disclosed which contains the $\beta$-stabilizing element such as Fe as well as O of a predetermined amount with the remainder consisting of Ti and inevitable impurities, and in which the area ratio of the $\alpha$ phase whose average value of the angle between the normal direction of the (0001) plane of the $\alpha$ phase and the normal direction of the rolling plane is 60° or less and the angle is 70° or more relative to the entire $\alpha$ phase is 30% or less.

In Patent Literature 4, a titanium plate having a high strength and excellent in deep drawability is disclosed which contains the $\beta$-stabilizing element such as Fe as well as O of a predetermined amount with the remainder consisting of Ti and inevitable impurities, and in which the area ratio of the $\alpha$ phase whose average value of the inclination angle between the normal direction of the (0001) plane of the $\alpha$ phase and the normal direction of the rolling plane is 45° or less and the inclination angle is 50° or more relative to the entire $\alpha$ phase is 10% or less.

CITATION LIST

Patent Literature

Patent Literature 1: Japanese Patent No. 4088183

Patent Literature 2: Japanese Unexamined Patent Application Publication No. 2008-127633

Patent Literature 3: Japanese Unexamined Patent Application Publication No. 2010-031314

Patent Literature 4: Japanese Unexamined Patent Application Publication No. 2010-150607

SUMMARY OF INVENTION

Technical Problem

According to the technologies disclosed in Patent Literatures 1-4, improvement of the formability is intended by controlling the grain microstructure of the $\alpha$ phase of the titanium plate. However, the titanium plates of Patent Literatures 1-4 cannot be deemed to have secured sufficient formability, and further improvement of the formability is desired.

The present invention has been developed in view of the problems described above, and its object is to provide a titanium plate that has high strength and exerts excellent formability.

Solution to Problem

As a result of intensive studies on the composition and the like of the titanium plate, the present inventors found out that a titanium plate having high strength and excellent in formability could be obtained by making the content of Fe and O a predetermined amount and by precisely controlling the way of the orientation of the C-axis in controlling the grain microstructure of the α phase that was the main phase of the titanium plate, and the present invention was achieved.

The details are as follows.

The titanium plate related with the present invention is a titanium plate containing Fe: from 0.020 to 1.000 mass % and O: from 0.020 to 0.400 mass % with the remainder consisting of titanium and inevitable impurities and including the grain microstructure of the α phase that has a HCP structure, in which the total area of α phase grains included in a first angle range (X1) where the first angle (θ) between a normal direction of the (0001) plane and a ND direction that is the normal direction of the rolling plane in the (0001) pole figure of the α phase grain is from 0° to 50° is 0.40 or more in terms of a ratio (P) relative to the total area of entire α phase grains, an area ratio (Q) expressed by (A)/(B) is from 0.20 to 5.00 with (A) being the total area of α phase grains included in a range where the second angle (φ) between a plane including the normal direction and the ND direction and a plane including the ND direction and a RD direction that is the rolling direction is from 0° to 45° in the first angle range (X1) and with (B) being the total area of α phase grains included in a range where the second angle (φ) is over 45° and 90° or less, the total area of α phase grains included in a second angle range (X2) where the first angle (θ) is from 80° to 90° is 0.15 or more in terms of a ratio (R) relative to the total area of entire α phase grains, an area ratio (S) expressed by (C)/(D) is from 0.20 to 5.00 with (C) being the total area of α phase grains included in a range where the second angle (φ) is from 0° to 45° in the second angle range (X2) and with (D) being the total area of α phase grains included in a range where the second angle (φ) is over 45° and 90° or less, and the average value of an equivalent circle diameter in the α phase grains is from 5 μm to 100 μm, and the maximum value of the equivalent circle diameter is 200 μm or less. Also, the titanium plate of the present invention may further contain N: 0.050 mass % or less, C: 0.100 mass % or less, and Al: 1.000 mass % or less.

According to the constitutions described above, with respect to the titanium plate of the present invention, the strength increases and the formability improves by containing a predetermined amount of Fe and O, or by further containing C, N, and Al. Also, with respect to the titanium plate, anisotropy of the proof stress of the rolling direction and transverse direction, elongation, and the formability further improves by that the crystal orientation is within a predetermined range in the (0001) pole figure of the α phase grain namely the ratio (P) or the ratio (R) of the total area of the α phase grains included in a range determined by the first angle (θ) relative to the total area of the entire α phase grains is within a predetermined range and the area ratio (Q) or the area ratio (S) of the total area of the α phase grains included in two ranges determined by the second angle (φ) is within a predetermined range.

Advantageous Effect of Invention

The titanium plate related with the present invention can exert excellent formability in spite that the strength is high.

DESCRIPTION OF EMBODIMENTS

Figure 1A:
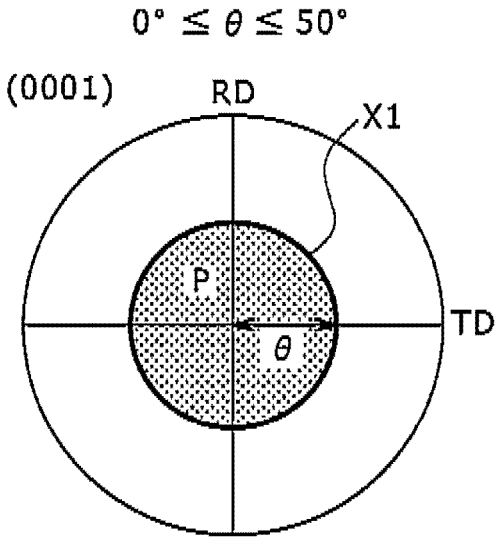
FIG. 1A is a drawing showing the crystal orientation of the α phase grain of a titanium plate, and showing a range (X1) defined by the first angle (θ) in order to calculate the ratio (P) of the α phase grain in the pole figure that shows the distribution in the normal direction (axial orientation) of the (0001) plane as viewed from the orthogonal direction with respect to the rolling plane.

Below, embodiments of the present invention will be explained in detail.

« Titanium Plate»

The titanium plate related with the present invention is a titanium plate that contains a predetermined amount of Fe and O with the remainder consisting of titanium and inevitable impurities and includes the grain microstructure of the α phase that has a HCP structure (hexagonal closest packing structure) in which the α phase grain has a predetermined crystal orientation and equivalent circle diameter in the (0001) pole figure of the α phase grain. Also, the titanium plate may further contain a predetermined amount of N, C, and Al. Below, respective constitutions will be explained.

(Fe: From 0.020 to 1.000 Mass %)

Fe is an important element in improving the strength of the titanium plate. When the content of Fe is less than 0.020 mass %, the strength of the titanium plate is insufficient, the equivalent circle diameter of the α phase grain is extremely coarsened by final annealing, and the formability deteriorates. Also, the sponge titanium of high purity comes to be used, and the cost increases which is not feasible industrially. In contrast, when the Fe content exceeds 1.000 mass %, segregation in the ingot increases, and the productivity deteriorates. Also, the β phase that has a BCC structure (body centered cubical lattice structure) increases and becomes the fracture origin, and the formability deteriorates. Accordingly, the content of Fe is made from 0.020 to 1.000 mass %. Also, the lower limit is preferably 0.025 mass % or more. The upper limit is preferably 0.250 mass % or less, and more preferably 0.120 mass % or less.

(O: From 0.020 to 0.400 Mass %)

O is an element deteriorating the formability of the titanium plate while increasing the strength. When the content of O is less than 0.020 mass %, the strength of the titanium plate is insufficient, the sponge titanium of high purity comes to be used, and the cost increases which is not feasible industrially. In contrast, when the content of O exceeds 0.400 mass %, the titanium plate becomes too brittle, and the crack is liable to be generated at the time of cold rolling which results in deterioration of the productivity. Also, the formability deteriorates. Accordingly, the content of O is made from 0.020 to 0.400 mass %. Also, the lower limit is preferably 0.025 mass % or more. The upper limit is preferably 0.150 mass % or less, and more preferably 0.100 mass % or less.

(N: 0.050 Mass % or Less)

N is an element that is contained normally as the inevitable impurities but is effective in improving the strength by being added exceeding the inevitable impurities level. However, when the content of N exceeds 0.050 mass %, the titanium plate becomes too brittle, and the formability deteriorates. Therefore, when N is to be added to the titanium plate, the content of N is made 0.050 mass % or less, preferably 0.014 mass % or less.

(C: 0.100 Mass % or Less)

C is an element that is contained normally as the inevitable impurities but is effective in improving the strength by being added exceeding the inevitable impurities level. However, when the content of C exceeds 0.100 mass %, the titanium plate becomes too brittle, and the formability deteriorates. Therefore, when C is to be added to the titanium plate, the content of C is made 0.100 mass % or less, preferably 0.050 mass % or less.

(Al: 1.000 Mass % or Less)

Al is an element that is contained normally as the inevitable impurities but is effective in improving the strength and heat resistance by being added exceeding the inevitable impurities level. However, when the content of Al exceeds 1.000 mass %, the formability deteriorates. Therefore, when Al is to be added to the titanium plate, the content of Al is made 1.000 mass % or less, preferably 0.400 mass % or less, and more preferably 0.200 mass % or less.

(Remainder: Titanium and Inevitable Impurities)

The composition of the titanium plate is as described above, and the remainder consists of titanium and inevitable impurities. The inevitable impurities are contained within a range not harmful to various properties of the titanium plate, and are Cr, Ni, H, and the like for example in addition to N, C, and Al described above.

(Crystal Orientation)

With respect to the titanium plate, the α phase grain has a predetermined crystal orientation. In the present invention, to have a predetermined crystal orientation means that the ratio (P) or the ratio (R) of the total area of the α phase grains included in the range determined by the first angle (θ) relative to the total area of the entire α phase grains is within a predetermined range in the (0001) pole figure of the α phase grain, and the area ratio (Q) or the area ratio (S) of the total area of the α phase grains included in two ranges determined by the second angle (φ) is within a predetermined range.

Figure 1B:
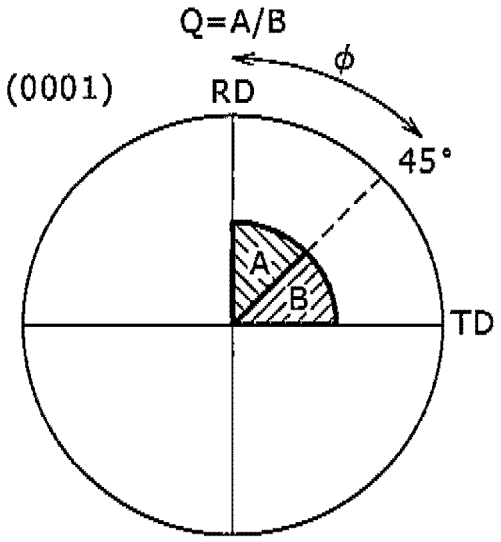
FIG. 1B is a drawing showing the crystal orientation of the α phase grain of a titanium plate, and showing a range defined by the second angle (φ) in order to calculate the area ratio (Q=A/B) of the α phase grain in the pole figure that shows the distribution in the normal direction (axial orientation) of the (0001) plane as viewed from the orthogonal direction with respect to the rolling plane.
Figure 1C:
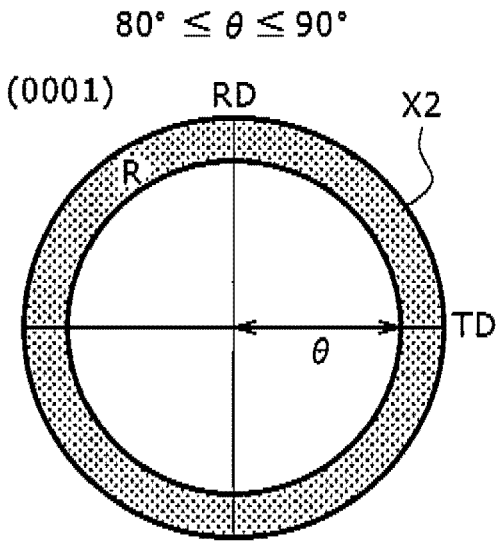
FIG. 1C is a drawing showing the range (X2) defined by the first angle (θ) in order to calculate the ratio (R) of the α phase grain according to FIG. 1A.
Figure 1D:
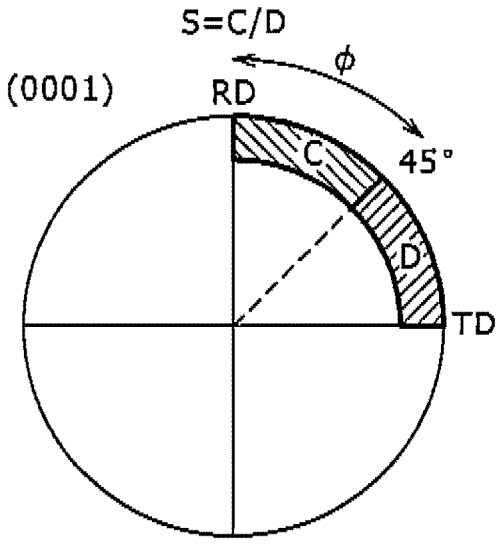
FIG. 1D is a drawing showing the range defined by the second angle (φ) in order to calculate the area ratio (S=C/D) of the α phase grain according to FIG. 1B.
Figure 2:
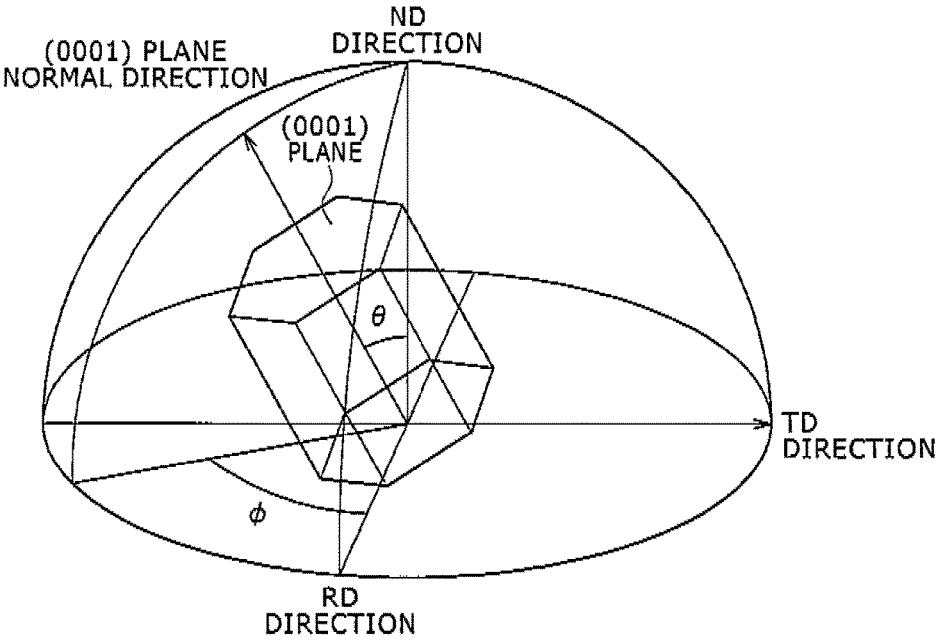
FIG. 2 is a conceptual drawing for explaining FIG. 1.

Here, the first angle (θ) is an angle between the normal direction of the (0001) plane and the ND direction that is the normal direction of the titanium plate (rolling plane) as shown in FIG. 2 in the orientation analysis by SEM-EBSD (scanning electron microscope-reflected electron image) and the like. Also, in FIG. 1A and FIG. 1C which are the pole figures by the SEM-EBSD, the first angle (θ) is expressed by the length in the radial direction. Further, the second angle (φ) is an angle between the plane including the normal direction of the (0001) plane and the ND direction and the plane including the ND direction and the RD direction that is the rolling direction as shown in FIG. 2 in the orientation analysis by the SEM-EBSD and the like. Also, in FIG. 1B and FIG. 1D which are the pole figures by the SEM-EBSD, the second angle (φ) is expressed by the angle of circumference. Further, as shown in FIG. 1A to FIG. 1D and FIG. 2, the direction orthogonal to the RD direction in the rolling plane is made the TD direction.

Further, the predetermined range of the ratio (P), the area ratio (Q), the ratio (R), and the area ratio (S) of the α phase grain are achieved by controlling the temperature raising rate, the holding temperature, and the holding time in the final annealing step in manufacturing the titanium plate.

(1) Ratio (P): 0.40 or More

As shown in FIG. 1A and FIG. 2, the total area of the α phase grains included in the first angle range (X1) where the first angle (θ) between the normal direction of the (0001) plane and the ND direction that is the normal direction of the rolling plane is from 0° to 50° is 0.40 or more in terms of the ratio (P) relative to the total area of the entire α phase grains. The ratio (P) is preferably 0.50 or more. Also, the preferable upper limit is 0.80, and more preferably 0.75 or less.

Further, in the present invention, the total area of the entire α phase grains means the grand total of the area of the α phase grains in the observation region by the SEM-EBSD which is, in concrete terms, in the region of 0.5 mm in the rolling direction and 0.5 mm in the transverse direction.

Also, when the ratio (P) is less than 0.40, because the total area where the α phase grains are included is small, anisotropy of the proof stress, elongation and the like of the rolling direction and the transverse direction in the titanium plate increases. As a result, the formability of the titanium plate deteriorates.

(2) Area Ratio (Q): From 0.20 to 5.00

As shown in FIG. 1B and FIG. 2, the area ratio (Q) expressed by (A)/(B) is from 0.20 to 5.00 with (A) being the total area of the α phase grains included in the range where the second angle (φ) between the plane including the normal direction and the ND direction and the plane including the ND direction and the RD direction that is the rolling direction is from 0° to 45° in the first angle range (X1) and with (B) being the total area of the α phase grains included in the range where the second angle (φ) is over 45° and 90° or less.

When the area ratio (Q) is less than 0.20, anisotropy of the proof stress of the rolling direction, elongation, and the transverse direction in the titanium plate increases, and the formability of the titanium plate deteriorates. In contrast, also when the area ratio (Q) exceeds 5.00, anisotropy of the proof stress of the rolling direction, elongation, and the transverse direction in the titanium plate increases, and the formability of the titanium plate deteriorates.

(3) Ratio (R): 0.15 or More

As shown in FIG. 1C and FIG. 2, the total area of the α phase grains included in the second angle range (X2) where the first angle (θ) is from 80° to 90° is 0.15 or more in terms of the ratio (R) relative to the total area of the entire α phase grains. The total area of the entire α phase grains is similar to that described above. Further, the preferable upper limit is 0.50, and more preferably 0.45 or less.

When the ratio (R) is less than 0.15, because the total area where the α phase grains are included is small, anisotropy of the proof stress of the rolling direction and the transverse direction in the titanium plate increases, and the formability deteriorates.

(4) Area Ratio (S): From 0.20 to 5.00

As shown in FIG. 1D and FIG. 2, the area ratio (S) expressed by (C)/(D) is from 0.20 to 5.00 with (C) being the total area of the α phase grains included in the range where the second angle (φ) is from 0° to 45° in the second angle range (X2) and with (D) being the total area of the α phase grains included in the range where the second angle (φ) is over 45° and 90° or less.

When the area ratio (S) is less than 0.20, anisotropy of the proof stress of the rolling direction, elongation, and the transverse direction in the titanium plate increases, and the formability of the titanium plate deteriorates. In contrast, also when the area ratio (S) exceeds 5.00, anisotropy of the proof stress of the rolling direction, elongation, and the transverse direction in the titanium plate increases, and the formability of the titanium plate deteriorates.

With respect to the titanium plate, the α phase grains have a predetermined equivalent circle diameter. In concrete terms, the average value and the maximum value of the equivalent circle diameter are within a predetermined range. Also, the equivalent circle diameter of the α phase grains of the predetermined range is achieved by controlling the Fe content of the titanium plate, and the temperature raising rate, the holding temperature, the holding time, and the cooling rate in the final annealing step at the time of manufacturing.

(Average Value of Equivalent Circle Diameter in α Phase Grains: From 5 μm to 100 μm)

When the average value of the equivalent circle diameter is less than 5 μm, the ductility of the titanium plate deteriorates, and the formability is liable to deteriorate. When the average value of the equivalent circle diameter exceeds 100 μm, rough surface is liable to occur. Therefore, the average value of the equivalent circle diameter is from 5 μm to 100 μm, and from 5 μm to 80 μm is preferable.

(Maximum Value of Equivalent Circle Diameter in α Phase Grains: 200 μm or Less)

When the maximum value of the equivalent circle diameter exceeds 200 μm, the distribution of the strain in coarse grains becomes non-uniform, the strain is liable to concentrate to the grain boundary, the crack is generated, and the formability is liable to deteriorate. Therefore, the maximum value of the equivalent circle diameter is 200 μm or less, and 150 μm or less is preferable.

Here, with respect to the equivalent circle diameter, the boundary where the orientation difference is 5° or more in the observation region of the SEM-EBSD is defined as the grain boundary, the area of the α phase grain surrounded by the grain boundary is approximated by a circle, and the diameter of the circle is defined as the equivalent circle diameter of the α phase grain.

Next, a method for manufacturing the titanium plate will be explained.

«Method for Manufacturing Titanium Plate»

The titanium plate described above is manufactured by a manufacturing method as described below for example.

Figure 3:
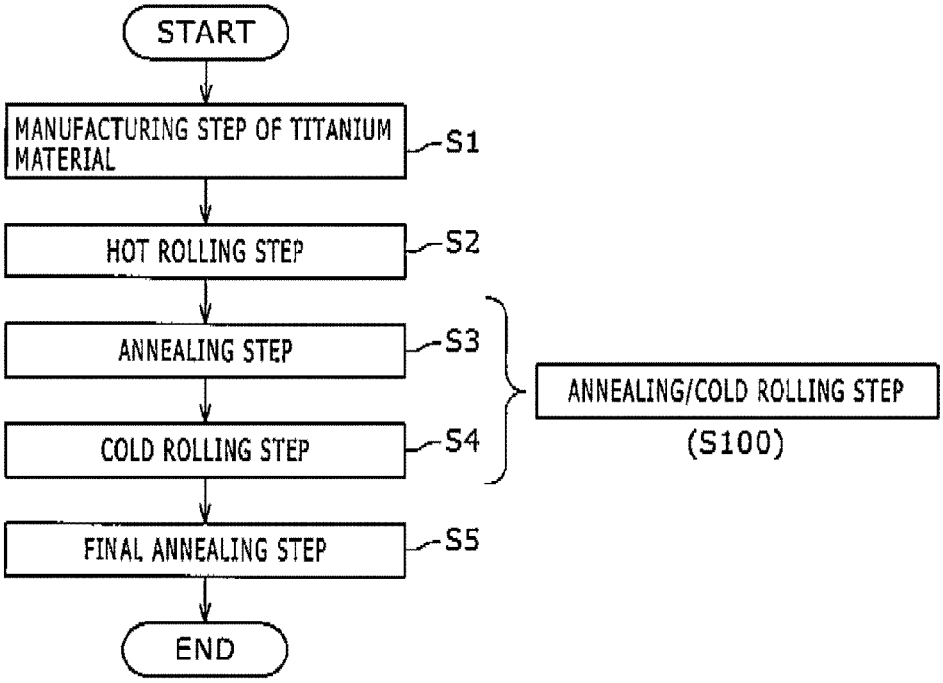
FIG. 3 is a process flowchart showing a method for manufacturing the titanium plate.

As shown in FIG. 3, the method for manufacturing the titanium plate includes a manufacturing step of titanium material S1, a hot rolling step S2, an annealing/cold rolling step S100, and a final annealing step S5.

Below, each step will be explained.

(Manufacturing Step of Titanium Material)

The manufacturing step of titanium material S1 is a step for manufacturing a titanium material that contains Fe and O with the remainder consisting of titanium and inevitable impurities or a titanium material that further contains N, C, and Al before the hot rolling step S2. When a titanium plate is to be manufactured, first, similarly to the case of manufacturing a titanium plate of a related art, an ingot (pure titanium for industrial use) is manufactured, the ingot is subjected to bloom forging or bloom rolling, and a titanium material that will be subjected to subsequent steps is obtained. The method for manufacturing the ingot, bloom forging or bloom rolling is not particularly limited, and a conventionally known method can be employed. For example, first, a raw material with a predetermined composition is molten by a consumable-electrode vacuum-arc melting method (VAR method) and is thereafter casted, and the titanium ingot is obtained. This ingot is subjected to bloom forging (hot forging) into a block shape of a predetermined size, and is made the titanium material. The composition of Fe and the like is as described above.

(Hot Rolling Step)

The hot rolling step S2 is a step for subjecting the titanium material to hot rolling. The method for hot rolling is not particularly limited, and a conventionally known method can be employed. For example, the titanium material may be heated to 700° C. to 1,050° C., and may be subjected to hot rolling.

(Annealing/Cold Rolling Step)

The annealing/cold rolling step S100 is a step for executing an annealing step S3 and a cold rolling step S4 after the hot rolling step S2.

The annealing step S3 is a step for subjecting a hot rolled plate manufactured in the step described above to annealing, the method for annealing is not particularly limited, and a conventionally known method can be employed. For example, it is preferable to subject the hot rolled plate to annealing at the holding temperature: from 600° C. to 850° C. Further, with respect to the annealing atmosphere also, any of the atmospheric air, vacuum, and reduction gas atmosphere can be employed, and the annealing step S3 may be executed in either of a batch furnace and a continuous furnace.

The cold rolling step S4 is a step for subjecting the hot rolled plate having been subjected to annealing to cold rolling by once or more, the method for cold rolling is not particularly limited, and a conventionally known method can be employed. Also, intermediate annealing may be executed between cold rolling and cold rolling. Further, in that case, the compression reduction in the final cold rolling of the stage before the final annealing step may be of the same degree of that of the related art. The compression reduction can be approximately from 20% to 70% for example. However, it is preferable that the total rolling rate of the cold rolled plate manufactured by cold rolling namely the rolling rate for the hot rolled plate becomes from 20% to 98%.

(Final Annealing Step)

The final annealing step S5 is a step for executing final annealing after the annealing/cold rolling step S100.

Here, in order to obtain a desired microstructure form namely in order to make the crystal orientation of the titanium plate within a predetermined range and in order to make the equivalent circle diameter of the α phase grains of the titanium plate within a predetermined range, it is necessary to control the temperature raising rate, the holding temperature, the holding time, and the cooling rate in final annealing within a predetermined range as shown below.

However, the annealing condition other than the above is not particularly limited, and annealing may be executed with a conventionally known condition. For example, with respect to the atmosphere, any of the atmospheric air, vacuum, and reduction gas atmosphere can be employed, and annealing step may be executed in either of a batch furnace and a continuous furnace.

(Temperature Raising Rate: 10° C./s or More)

When the temperature raising rate in the final annealing step S5 is less than 10° C./s, the β phase grains are coarsened when the α phase is transformed to the β phase by annealing. As a result, because the aggregate microstructure extremely changes accompanying growth of the β phase grains and any of the ratio (P), the area ratio (Q), the ratio (R), and the area ratio (S) of the crystal orientation of the α phase grain comes not to satisfy the predetermined range, the formability deteriorates. Further, because the α phase grains in the titanium plate are also coarsened and the maximum value of the equivalent circle diameter of the α phase grains exceeds the upper limit value, the formability deteriorates. Accordingly, the temperature raising rate is made 10° C./s or more. On the other hand, because of the limit of the capacity of the facilities of the final annealing step, the temperature raising rate cannot be increased so as to exceed 200° C./s.

(Holding Temperature: Equal to or Above Temperature at which Area Fraction of β Phase Relative to α Phase Becomes 50% and Below 950° C.)

When the holding temperature at the final annealing step S5 is below a temperature at which the area fraction of the β phase becomes 50%, any of the ratio (P), the area ratio (Q), the ratio (R), and the area ratio (S) of the crystal orientation of the α phase grain comes not to satisfy the predetermined range, and therefore the formability deteriorates. Further, because the α phase grains in the titanium plate are also coarsened and the maximum value of the equivalent circle diameter of the α phase grains exceeds the upper limit value, the formability deteriorates. In contrast, if the holding temperature is 950° C. or above, when the α phase is transformed to the β phase by annealing, the β phase grains are coarsened. As a result, because the α phase grains in the titanium plate are also coarsened and the maximum value of the equivalent circle diameter of the α phase grains exceeds the upper limit value, the formability deteriorates. Accordingly, the holding temperature is made equal to or above a temperature at which the area fraction of the β phase becomes 50% and below 950° C.

(Holding Time: 300 s or Less (Inclusive of 0 s)

When the holding time in the final annealing step S5 exceeds 300 s, the β phase grains are coarsened when the α phase is transformed to the β phase by annealing. As a result, because the aggregate microstructure extremely changes accompanying growth of the β phase grains and any of the ratio (P), the area ratio (Q), the ratio (R), and the area ratio (S) of the crystal orientation of the α phase grain comes not to satisfy the predetermined range, the formability deteriorates. Further, because the α phase grains in the titanium plate are also coarsened and the maximum value of the equivalent circle diameter of the α phase grains exceeds the upper limit value, the formability deteriorates. Accordingly, the holding time is made 300 s or less. Also, the holding time is to include 0 s. "The holding time is 0 s" means that cooling described below is executed as soon as the annealing temperature reaches the range of the holding temperature described above.

(Cooling Rate: 10° C./s or More)

When the cooling rate in the final annealing step S5 is less than 10° C./s, the α phase grains are coarsened when the β phase is transformed to the α phase by cooling. As a result, because the maximum value of the equivalent circle diameter of the α phase grains of the titanium plate exceeds the upper limit value, the formability deteriorates. Accordingly, the cooling rate is made 10° C./s or more. On the other hand, because of the limit of the capacity of the facilities of the final annealing step, the cooling rate cannot be increased so as to exceed 1,000° C./s.

Although the method for manufacturing the titanium plate is as described above, in manufacturing a titanium plate, other steps may be included between, before or after respective steps described above in a range not harmfully affecting the respective steps described above. For example, when scale is attached to the surface of the titanium plate after each annealing, a step for removing the scale may be included. As a step for removing the scale, a salt heat treatment step, a pickling treatment step, and the like can be cited for example. In addition, a foreign object removing step for removing a foreign object of the surface of the titanium plate, a defective product removing step for removing a defective product generated in each step, and so on for example may be included.

Also, in the manufacturing method of the present invention, such method is also possible not to execute the annealing step S3 but to execute only the cold rolling step S4 of executing cold rolling by once or more. At that time, in the cold rolling step S4, intermediate annealing may be executed between cold rolling and cold rolling.

The titanium plate of the present invention can be used as members for a heat exchanger of a chemical plant, a power plant, a food processing plant, and the like, consumer products such as a camera body and a kitchen instrument, members for transportation equipment such as a motorcycle and an automobile, exterior material for household electrical appliances and the like, and a separator for a fuel cell. Particularly, the titanium plate of the present invention can be suitably used for a plate type heat exchanger in which excellent formability is required.

EXAMPLES

Below, the present invention will be explained more specifically referring to examples.

A material having the composition shown in Table 1 formed of a pure titanium ingot with Fe and O composition (JIS H 4600) or a titanium ingot obtained by adding additive elements such as N to the pure titanium ingot was molten by the VAR method and was casted, and a titanium ingot was obtained. Next, this ingot was subjected to bloom forging (hot forging), and was made the titanium material. This titanium material was subjected to hot rolling, and a hot rolled plate with 4.0 mm thickness was obtained. Further, after removing the scale of the surface of the hot rolled plate, cold rolling, intermediate annealing, and cold rolling were executed, and a cold rolled plate with 0.55 mm thickness was obtained. Also, the cold rolled plate was subjected to final annealing in a condition shown in Table 1, descale treatment by a salt bath treatment and pickling was executed, and a test sample with 0.5 mm thickness was obtained. Further, the intermediate annealing and the final annealing were executed in a continuous annealing furnace. Also, the value of the temperature at which the area fraction of the β phase in Table 1 becomes 50% is the lower limit value of the holding temperature in the final annealing step, and is a value calculated using a thermodynamics calculation software "Thermo-Calc".

With respect to the test sample, the crystal orientation and the equivalent circle diameter of the α phase grain were obtained by a method below. Also, the strength and the formability were evaluated by a method below.

(Crystal Orientation and Equivalent Circle Diameter of α Phase Grain)

The microstructure of the region of 0.5 mm in the rolling direction and 0.5 mm in the transverse direction was observed by the SEM-EBSD in the rolling plane of the surface layer part in the plate thickness direction, the ¼t part, and the plate thickness center part of the test material.

From the result, the boundary having the orientation difference of 5° or more was recognized to be the grain boundary, and the orientation composition was analyzed based on the orientation of each grain. Also, the equivalent circle diameter (average value, maximum value) of each grain was calculated. Further, the measurement was performed at 10 locations, and the average was obtained. The result is shown in Table 1.

(Evaluation of Strength)

No. 13 test piece specified in JIS Z 2201 was taken from the test sample in the direction (L direction) along which the rolling direction of the test sample agreed to the loading axis, the tensile test was executed based on JIS H 4600 at the room temperature, and 0.2% proof stress (YS) was measured. The result is shown in Table 1. The case (YS) was from 138 to 620 (MPa) was evaluated to have passed.

(Evaluation of Formability)

The formability was evaluated by subjecting each test sample to press-forming using a forming die that imitated the heat exchanging section (plate) of the plate type heat exchanger.

Figure 4A:
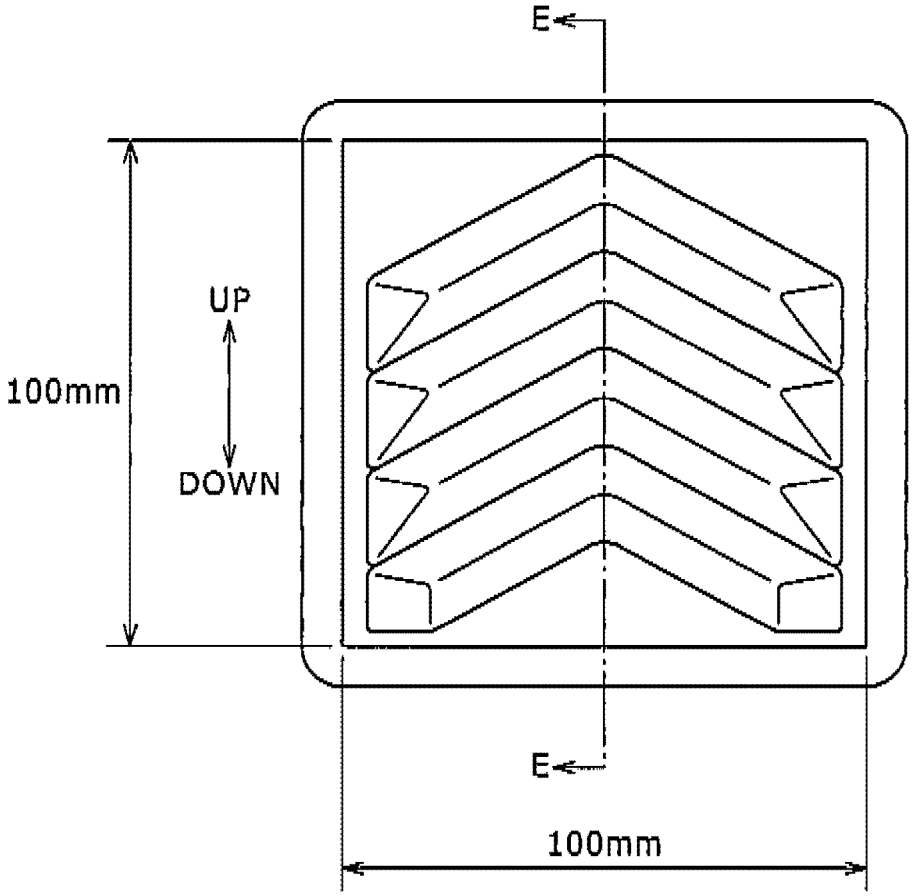
FIG. 4A is a schematic view showing the shape of a forming die for evaluating the formability in an example, and is a plan view thereof.
Figure 4B:
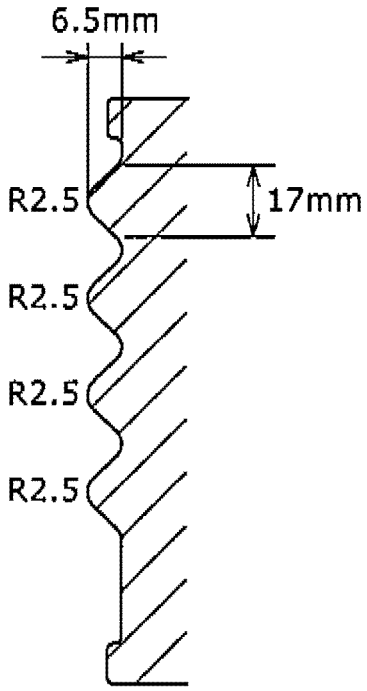
FIG. 4B is a cross-sectional view taken along the line E-E of FIG. 4A.

As shown in FIG. 4A and FIG. 4B, with respect to the shape of the forming die, the forming section is 100 mm×100 mm and has 4 ridge sections with 17 mm pitch and 6.5 mm maximum height, and each ridge section has a round shape with R=2.5 mm at the vertex.

Using this forming die, press-forming was executed by 80 ton press. In the press-forming, rust preventive oil was sprayed over both surfaces of each test sample for lubrication, and the test sample was disposed on the lower die so that the rolling direction of each test sample agreed to the vertical direction of FIG. 4A. After restricting the flange section by a plate clamp, the die was pressed in with the condition of 1 mm/s of pressing speed. The die was pressed in at intervals of 0.1 mm, and the maximum press-in depth amount (E: unit was mm) with which the crack was not generated was obtained by the experiment. Also, the formability index (F) was calculated by the expressions below. The result is shown in Table 1. Further, the case the formability index (F) became a positive value was evaluated to have passed.

$$F=E-(G-H\times YS)$$

$$G=6.0857,\ H=0.0094$$

YS: a value obtained by making the 0.2% proof stress in the L direction (rolling direction) dimensionless E: a value obtained by making the maximum press-in depth amount dimensionless

TABLE 1

| Test sample | Composition (mass %) | | | | | Temperature at which area fraction of β phase becomes 50% (° C.) | Final annealing | | | |
|---|---|---|---|---|---|---|---|---|---|---|
| | | | | | | | Temperature raising rate | Holding temperature | Holding time | Cooling rate |
| No. | Fe | O | N | C | Al | | (° C./s) | (° C.) | (s) | (° C./s) |
| 1 | 0.030 | 0.030 | — | — | — | 883 | 10 | 895 | 20 | 20 |
| 2 | 0.025 | 0.070 | — | — | — | 885 | 15 | 900 | 10 | 15 |
| 3 | 0.050 | 0.090 | — | — | — | 886 | 30 | 910 | 5 | 25 |
| 4 | 0.080 | 0.120 | — | — | — | 886 | 20 | 905 | 30 | 10 |
| 5 | 0.140 | 0.180 | — | — | — | 888 | 15 | 890 | 280 | 15 |
| 6 | 0.350 | 0.220 | — | — | — | 881 | 25 | 925 | 8 | 35 |
| 7 | 0.050 | 0.090 | 0.030 | — | — | 890 | 20 | 915 | 15 | 30 |
| 8 | 0.050 | 0.090 | — | 0.060 | — | 894 | 10 | 900 | 120 | 20 |
| 9 | 0.050 | 0.090 | — | — | 0.800 | 904 | 40 | 945 | 1 | 50 |
| 10 | 0.010 | 0.025 | — | — | — | 883 | 15 | 910 | 60 | 15 |
| 11 | 1.100 | 0.150 | — | — | — | 846 | 15 | 910 | 60 | 15 |
| 12 | 0.150 | 0.500 | — | — | — | 911 | 15 | 915 | 60 | 15 |
| 13 | 0.050 | 0.090 | 0.060 | — | — | 895 | 15 | 910 | 60 | 15 |
| 14 | 0.050 | 0.090 | — | 0.120 | — | 903 | 15 | 910 | 60 | 15 |
| 15 | 0.050 | 0.090 | — | — | 1.200 | 912 | 15 | 915 | 60 | 15 |
| 16 | 0.050 | 0.090 | — | — | — | 886 | 2 | 910 | 60 | 15 |
| 17 | 0.050 | 0.090 | — | — | — | 886 | 15 | 880 | 60 | 15 |
| 18 | 0.050 | 0.090 | 0.020 | — | 0.400 | 898 | 3 | 860 | 200 | 10 |
| 19 | 0.050 | 0.090 | — | — | — | 886 | 15 | 950 | 60 | 15 |
| 20 | 0.050 | 0.090 | — | — | — | 886 | 15 | 910 | 330 | 15 |
| 21 | 0.050 | 0.090 | — | — | — | 886 | 15 | 910 | 60 | 2 |

| Test sample | α phase grain | | | | | | Strength 0.2% | Formability | |
|---|---|---|---|---|---|---|---|---|---|
| | Crystal orientation | | | | Equivalent circle diameter average value | Equivalent circle diameter maximum value | proof stress YS | Press-in depth amount E | Formability index F |
| No. | P | Q | R | S | (μm) | (μm) | (MPa) | (mm) | |
| 1 | 0.46 | 0.22 | 0.18 | 0.30 | 31 | 181 | 172 | 4.8 | 0.33 |
| 2 | 0.53 | 0.25 | 0.26 | 0.96 | 27 | 179 | 238 | 4.5 | 0.65 |
| 3 | 0.60 | 0.26 | 0.23 | 0.67 | 17 | 156 | 265 | 4.5 | 0.91 |
| 4 | 0.50 | 0.29 | 0.40 | 0.76 | 14 | 193 | 303 | 4.0 | 0.76 |
| 5 | 0.57 | 1.28 | 0.31 | 1.14 | 8 | 147 | 409 | 3.5 | 1.26 |

TABLE 1-continued

| | | | | | | | | | |
|---|---|---|---|---|---|---|---|---|---|
| 6 | 0.71 | 2.80 | 0.24 | 2.10 | 9 | 142 | 458 | 2.9 | 1.12 |
| 7 | 0.62 | 1.39 | 0.22 | 3.41 | 11 | 167 | 281 | 4.4 | 0.96 |
| 8 | 0.57 | 0.58 | 0.21 | 0.83 | 8 | 158 | 297 | 4.2 | 0.91 |
| 9 | 0.65 | 4.51 | 0.24 | 4.19 | 45 | 196 | 309 | 3.9 | 0.72 |
| 10 | 0.62 | 0.27 | 0.21 | 0.42 | 117 | 274 | 121 | 4.6 | −0.35 |
| 11 | 0.51 | 0.21 | 0.17 | 0.24 | 7 | 211 | 430 | 2.0 | −0.04 |
| 12 | 0.55 | 0.24 | 0.19 | 0.20 | 25 | 192 | 517 | 1.1 | −0.13 |
| 13 | 0.58 | 0.22 | 0.18 | 0.23 | 5 | 183 | 462 | 1.6 | −0.14 |
| 14 | 0.53 | 0.23 | 0.18 | 0.22 | 5 | 189 | 451 | 1.6 | −0.25 |
| 15 | 0.58 | 0.21 | 0.16 | 0.26 | 6 | 183 | 335 | 2.9 | −0.04 |
| 16 | 0.61 | 0.23 | 0.31 | 0.22 | 38 | 238 | 244 | 3.6 | −0.19 |
| 17 | 0.60 | 0.11 | 0.05 | 0.40 | 46 | 230 | 253 | 3.5 | −0.21 |
| 18 | 0.48 | 0.09 | 0.12 | 0.18 | 12 | 196 | 281 | 3.2 | −0.24 |
| 19 | 0.72 | 0.68 | 0.23 | 0.56 | 63 | 337 | 227 | 3.8 | −0.15 |
| 20 | 0.63 | 1.69 | 0.14 | 0.72 | 52 | 286 | 231 | 3.8 | −0.11 |
| 21 | 0.69 | 0.63 | 0.21 | 0.72 | 32 | 240 | 232 | 3.7 | −0.20 |

(Note)
The remainder of the composition consists of Ti and inevitable impurities.
(Note)
Underlined numerical value shows that the requirement of the present invention is not satisfied.
(Note)
"—" shown instead of a numerical value shows that the composition is contained by an inevitable impurities level.

The test samples Nos. 1-9 (examples) are the titanium plates satisfying the requirement specified in the present invention, can be determined to have passed in both of the strength and formability, and are turned out to be excellent in the balance of the strength and formability.

In contrast, the test samples Nos. 10-21 (comparative examples) do not satisfy the requirement specified in the present invention, therefore the strength and formability do not satisfy the criteria of passing, and the balance of the strength and formability is turned out to be inferior.

In the test sample No. 10 (comparative example), because the Fe concentration was less than the lower limit value and the average value and the maximum value of the equivalent circle diameter exceeded the upper limit values, the strength and the formability were inferior.

In the test sample No. 11 (comparative example), because the Fe concentration exceeded the upper limit value and the maximum value of the equivalent circle diameter exceeded the upper limit value, the formability was inferior.

In the test sample No. 12 (comparative example), because the O concentration exceeded the upper limit value, the formability was inferior.

In the test sample No. 13 (comparative example), because the N concentration exceeded the upper limit value, the formability was inferior.

In the test sample No. 14 (comparative example), because the C concentration exceeded the upper limit value, the formability was inferior.

In the test sample No. 15 (comparative example), because the Al concentration exceeded the upper limit value, the formability was inferior.

In the test sample No. 16 (comparative example), because the temperature raising rate of the final annealing was less than the lower limit value and the maximum value of the equivalent circle diameter exceeded the upper limit values, the formability was inferior.

In the test sample No. 17 (comparative example), because the holding temperature of the final annealing was less than the lower limit value, the area ratio (Q) and the ratio (R) of the crystal orientation became less than the lower limit values, and the maximum value of the equivalent circle diameter also exceeded the upper limit value. As a result, the formability was inferior. Also, the test sample No. 17 (comparative example) is a titanium plate equivalent to that of Patent Literature 1.

In the test sample No. 18 (comparative example), because the temperature raising rate of the final annealing was less than the lower limit value and the holding temperature was less than the lower limit value, the area ratio (Q), the ratio (R), and the area ratio (S) of the crystal orientation became less than the lower limit values. As a result, the formability was inferior.

In the test sample No. 19 (comparative example), because the holding temperature of the final annealing exceeded the upper limit value, the maximum value of the equivalent circle diameter exceeded the upper limit value. As a result, the formability was inferior.

In the test sample No. 20 (comparative example), because the holding time of the final annealing exceeded the upper limit value, the ratio (R) of the crystal orientation became less than the lower limit value. Also, the maximum value of the equivalent circle diameter exceeded the upper limit value. As a result, the formability was inferior.

In the test sample No. 21 (comparative example), because the cooling rate of the final annealing was less than the lower limit value, the maximum value of the equivalent circle diameter exceeded the upper limit value. As a result, the formability was inferior.

Although the titanium plate related with the present invention was explained in detail above referring to the embodiments and the examples, the gist of the present invention is not limited to the contents described above, and the scope of the right thereof is to be interpreted based on the description of the claims. Also, it is needless to mention that the content of the present invention can be altered, amended, and so on based on the description described above.

Further, the present application is based on the Japanese Patent Application (No. 2013-197238) applied on Sep. 24, 2013, and the contents thereof are incorporated by reference into the present application.

INDUSTRIAL APPLICABILITY

The titanium plate of the present invention is useful for members for a heat exchanger of a chemical plant, a power plant, a food processing plant, and the like, consumer products such as a camera body and a kitchen instrument, members for transportation equipment such as a motorcycle and an automobile, exterior material for household electrical appliances and the like, a separator for a fuel cell, and so on, has excellent formability particularly, and is therefore suitable to a plate type heat exchanger.

REFERENCE SIGNS LIST

X1: First angle range
X2: Second angle range
θ: First angle
φ: Second angle
P, R: Ratio
Q, S: Area ratio
A, B, C, D: Total area
S1: Manufacturing step of titanium material
S2: Hot rolling step
S3: Annealing step
S4: Cold rolling step
S5: Final annealing step
S100: Annealing/cold rolling step

The invention claimed is:

1. A titanium plate, comprising:
Fe: from 0.020 to 1.000 mass %;
O: from 0.020 to 0.400 mass %;
titanium; and
inevitable impurities,
and including a grain microstructure of α phase that has a HCP structure,
wherein:
a total area of α phase grains included in a first angle range (X1) where a first angle (θ) between a no al direction of the (0001) plane and a ND direction that is a normal direction of a rolling plane in an (0001) pole figure of an α phase grain is from 0° to 50° is 0.40 or more in terms of a ratio (P) relative to the total area of entire α phase grains;
an area ratio (Q) expressed by (A)/(B) is from 0.20 to 5.00 with (A) being a total area of α phase grains included in a range where a second angle (φ) between a plane including the normal direction and the ND direction and a plane including the ND direction and a RD direction that is the rolling direction is from 0° to 45° in the first angle range (X1) and with (B) being a total area of α phase grains included in a range where the second angle (φ) is over 45° and 90° or less;
the total area of α phase grains included in a second angle range (X2) where the first angle (θ) is from 80° to 90° is 0.15 or more in terms of a ratio (R) relative to the total area of entire α phase grains;
an area ratio (S) expressed by (C)/(D) is from 0.20 to 5.00 with (C) being a total area of α phase grains included in a range where the second angle (φ) is from 0° to 45° in the second angle range (X2) and with (D) being a total area of α phase grains included in a range where the second angle (φ) is over 45° and 90° or less; and
an average value of an equivalent circle diameter in the α phase grains is from 5 to 100 μm, and a maximum value of the equivalent circle diameter is 200 μm or less.

2. The titanium plate according to claim 1, further comprising:
N: 0.050 mass % or less;
C: 0.100 mass % or less; and
Al: 000 mass % or less.

3. The titanium plate according to claim 1 consisting of said Fe, O, titanium, and inevitable impurities.

4. The titanium plate according to claim 1, consisting of said Fe, O, N, C, Al, titanium, and inevitable impurities.

5. The titanium plate according to claim 1, wherein:
the total area of α phase grains included in the first angle range (X1) is 0.80 or less in terms of the ratio (P) relative to the total area of entire α phase grains; and
the total area of α phase grains included in the second angle range (X2) where the first angle (θ) is from 80° to 90° is 0.50 or less in terms of the ratio (R) relative to the total area of entire α phase grains.

6. The titanium plate according to claim 1, wherein:
the total area of α phase grains included in the first angle range (X1) is 0.50-0.75 in terms of the ratio (P) relative to the total area of entire α phase grains; and
the total area of α phase grains included in the second angle range (X2) where the first angle (θ) is from 80° to 90° is 0.45 or less in terms of the ratio (R) relative to the total area of entire α phase grains.

7. The titanium plate according to claim 2, wherein:
the total area of α phase grains included in the first angle range (X1) is 0.80 or less in terms of the ratio (P) relative to the total area of entire α phase grains; and
the total area of α phase grains included in the second angle range (X2) where the first angle (θ) is from 80° to 90° is 0.50 or less in terms of the ratio (R) relative to the total area of entire α phase grains.

8. The titanium plate according to claim 2, wherein:
the total area of α phase grains included in the first angle range (X1) is 0.50-0.75 in terms of the ratio (P) relative to the total area of entire α phase grains; and
the total area of α phase grains included in the second angle range (X2) where the first angle (θ) is from 80° to 90° is 0.45 or less in terms of the ratio (R) relative to the total area of entire α phase grains.

9. The titanium plate according to claim 1, wherein the average value of the equivalent circle diameter in the α phase grains is from 5 to 80 μm, and the maximum value of the equivalent circle diameter is 200μm or less.

10. The titanium plate according to claim 1, wherein the average value of the equivalent circle diameter in the α phase grains is from 5 to 80 μm, and the maximum value of the equivalent circle diameter is 150 μm or less.

11. The titanium plate according to claim 2, wherein the average value of the equivalent circle diameter in the α phase grains is from 5 to 80 μm, and the maximum value of the equivalent circle diameter is 200 μm or less.

12. The titanium plate according to claim 2, wherein the average value of the equivalent circle diameter in the α phase grains is from 5 to 80 μm, and the maximum value of the equivalent circle diameter is 150 μm or less.

13. The titanium plate according to claim 5, wherein the average value of the equivalent circle diameter in the α phase grains is from 5 to 80 μm, and the maximum value of the equivalent circle diameter is 200 μm or less.

14. The titanium plate according to claim 5, wherein the average value of the equivalent circle diameter in the α phase grains is from 5 to 80 μm, and the maximum value of the equivalent circle diameter is 150 μm or less.

15. The titanium plate according to claim 5, comprising:
Fe: from 0.025 to 0.250 mass %; and
O: from 0.025 to 0.150 mass %.

16. The titanium plate according to claim 15, wherein the titanium plate further comprises:
N: 0.014 mass % or less;
C: 0.050 mass % or less; and
Al: 0.400 mass % or less.

* * * * *